US009541089B2

(12) United States Patent
Yamashita

(10) Patent No.: US 9,541,089 B2
(45) Date of Patent: Jan. 10, 2017

(54) ELECTRICALLY DRIVEN DUAL PUMP

(71) Applicant: MAHLE FILTER SYSTEMS JAPAN CORPORATION, Tokyo (JP)

(72) Inventor: Takahisa Yamashita, Tokyo (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 690 days.

(21) Appl. No.: 13/962,391

(22) Filed: Aug. 8, 2013

(65) Prior Publication Data

US 2014/0050606 A1 Feb. 20, 2014

(30) Foreign Application Priority Data

Aug. 14, 2012 (JP) ..... 2012-179739

(51) Int. Cl.
*F04C 15/00* (2006.01)
*F04D 13/06* (2006.01)
(Continued)

(52) U.S. Cl.
CPC ..... *F04D 13/06* (2013.01); *F04B 17/03* (2013.01); *F04C 2/332* (2013.01); *F04C 11/001* (2013.01); *F04C 11/008* (2013.01); *F04C 15/008* (2013.01)

(58) Field of Classification Search
CPC ..... F04C 2/32; F04C 2/332; F04C 2/336; F04C 2/3441; F04C 2/3443; F04C 2/3445; F04C 2/348; F04C 2/352; F04C 11/001; F04C 11/008; F04C 18/38; F04C 18/39; F04C 18/40; F04C 18/44; F04C 15/06; F04C 15/008; F04C 19/005; F04C 29/12; F04C 29/0085; F04C 2240/30; F04C 2240/40; F04C 2250/10; F04C 2250/101; F04C 2250/102
(Continued)

(56) References Cited

U.S. PATENT DOCUMENTS 2,312,886 A * 3/1943 Ellinwood ..... F04C 2/3442 418/212
2,949,924 A * 8/1960 Cochran, Jr. ..... F04C 11/001 137/99
(Continued)

FOREIGN PATENT DOCUMENTS

CA WO 2010096924 A1 * 9/2010 ..... F04C 2/3442
CH 316 899 A 10/1956
(Continued)

OTHER PUBLICATIONS

Japanese Office Action, Apr. 26, 2016, 3 pages.
European Extended Search Report, Jun. 4, 2014, 8 pages.

*Primary Examiner* — William H Rodriguez
*Assistant Examiner* — Charles Nichols
(74) *Attorney, Agent, or Firm* — Foley & Lardner LLP

(57) ABSTRACT

In an electrically driven dual pump, a cylindrical outer rotor is rotatably disposed with respect to the inner circumferential surface side of the housing and has a plurality of permanent magnets on an outer circumferential surface of the outer rotor to constitute a motor section in cooperation with coils of a housing, a partitioning plate is disposed to partition an inner circumferential side of the outer rotor into a first pump chamber and a second pump chamber, and each of first and second inner rotors is rotatably disposed within the first and second pump chambers with a rotation center of each of the first and second inner rotors eccentric to the center of the outer rotor and constitutes a space against the outer rotor which is communicated with a corresponding one of the suction ports and the corresponding one of the discharge ports.

10 Claims, 4 Drawing Sheets

(51) Int. Cl.

| | |
|---|---|
| ***F04B 17/03*** | (2006.01) |
| ***F04C 2/332*** | (2006.01) |
| ***F04C 11/00*** | (2006.01) |

(58) Field of Classification Search
USPC ..... 417/410.4
See application file for complete search history.

(56) References Cited

U.S. PATENT DOCUMENTS

| | | | | |
|---|---|---|---|---|
| 3,551,081 | A * | 12/1970 | Brundage | F04C 11/001 418/171 |
| 2003/0026722 | A1* | 2/2003 | Takagi | F04C 15/0049 418/171 |
| 2006/0213477 | A1 | 9/2006 | Schulz-Andres et al. | |
| 2012/0076678 | A1 | 3/2012 | Yamashita | |

FOREIGN PATENT DOCUMENTS

| | | | |
|---|---|---|---|
| DE | 881307 | C | 6/1953 |
| DE | 195 32 703 | C1 | 11/1996 |
| FR | 977 345 | A | 3/1951 |
| JP | 57-83290 | U | 5/1982 |
| JP | 58-220985 | A | 12/1983 |
| JP | 2002-221164 | A | 8/2002 |
| JP | 2006-517634 | A | 7/2006 |
| JP | 2012-067735 | A | 4/2012 |
| JP | 2012-67735 | A | 4/2012 |

* cited by examiner

ELECTRICALLY DRIVEN DUAL PUMP

BACKGROUND OF THE INVENTION (1) Field of the Invention

The present invention relates to an electrically driven oil pump utilized as an oil pump and particularly relates to an electrically driven dual pump in which pump mechanisms of two different systems are equipped.

(2) Description of Related Art

In a hybrid (automotive) vehicle in which an internal combustion engine is stopped under a particular vehicle driving condition which is one of vehicular drive sources, for a hydraulic pressure supply to a transmission during a stop of the engine, it is general practice that the electrically driven oil pump is used. In a case where two hydraulic pressure systems for each of which a requested hydraulic pressure or an oil quantity is different are present, it is desirable to provide a dual pump in which two pump mechanisms of the two systems are equipped.

Each of a Japanese Patent Application First Publication (tokuhyou) No. 2006-517634 published on Jul. 27, 2006 and a Japanese Utility Model Registration Application Publication No. Showa 57-083290 published on May 22, 1982 exemplifies a previously proposed composite oil pump.

In the previously proposed composite oil pump, a plurality of pump mechanisms are arranged in parallel to each other within a housing and a single drive shaft drives these pump mechanisms at the same time. In this case, the individual pump mechanisms are constituted by vane pumps, a rotor of each of the pump mechanisms is attached onto a common drive shaft.

In addition, a Japanese Patent Application First Publication No. 2012-067735 published on Apr. 5, 2012 exemplifies another previously proposed electrically driven oil pump. In this other previously proposed electrically driven oil pump, a housing in which coils are equipped and an outer rotor having permanent magnets constitute a kind of an electrically driven motor and an inner rotor is rotated together with the outer rotor to obtain a pump action.

SUMMARY OF THE INVENTION

However, in the previously proposed (former) composite oil pump disclosed in the above-described two Japanese Patent Application First Publications, the vane pumps are simply made in a multi-coupling structure and the required electrically driven motor becomes large-sized along with an increase in a drive torque. Hence, the whole pump including the motor becomes large-sized. In addition, the structure of the housing becomes easily complicated.

It is, hence, an object of the present invention to provide an electrically driven dual pump whose whole pump including the motor is small sized and simple in structure, utilizing the pump mechanism of the (latter) type described in the Japanese Patent Application First Publication No. 2012-067735.

According to one aspect of the present invention, there is provided an electrically driven dual pump, comprising: a housing comprising suction ports and discharge ports at respective end sections of the housing, the housing having a cylindrical inner circumferential surface and comprising a plurality of coils disposed in a circumferential direction of the housing; a cylindrical outer rotor rotatably disposed with respect to the inner circumferential surface side of the housing and having a plurality of permanent magnets on an outer circumferential surface of the outer rotor to constitute a motor section in cooperation with the coils of the housing; a partitioning plate disposed to partition an inner circumferential side of the outer rotor into a first pump chamber and a second pump chamber; first inner rotor and second inner rotor, each of the first and second inner rotors being rotatably disposed within the first and second pump chambers with a rotation center of each of the first and second inner rotors eccentric to the center of the outer rotor, constituting a space against the outer rotor which is communicated with a corresponding one of the suction ports and the corresponding one of the discharge ports, and a plurality of slots radially formed on an outer circumferential surface of each of the first and second inner rotors; and a plurality of linkage plates disposed to transmit a rotational force from the outer rotor to each of the first and second rotors, the respective linkage plates having an outer radial end section swingably supported on an inner circumferential section of the outer rotor and an inner radial end section slideably received in the respective slots of the first and second inner rotors, the linkage plates dividing the space formed between the outer rotor and each of the first and second inner rotors into a plurality of chambers.

In the above-described structure, the outer rotor is rotated in cooperation of the permanent magnets with the coils of the housing. The rotation of the outer rotor is transmitted to the first inner rotor and the second inner rotor via the plurality of linkage plates so that the outer rotor is rotated in the approximately same number of rotations per time as each of the first and second inner rotors. The space is present in a form of a crescent shape as a whole between the outer rotor and the first and second inner rotors and the linkage plates divide this space into the plurality of chambers. A volume of each of the chambers is varied along with the rotations of the outer rotor and the first and second inner rotors. Therefore, a pump action in which a fluid is supplied under pressure from each of the suction ports to a corresponding one of the discharge ports.

It should be noted that the single outer rotor serves to drive the two inner rotors. Hence, the electrically driven (dual) pump described above according to the present invention provides the dual pump so that a required (requested) rotational torque is increased. However, for example, as a result of elongation of a length of the outer rotor or the housing so as to have the first and second pump chambers as the dual pump, the permanent magnets and the coils of the housing can be expanded in an axial direction of the housing so that a large rotational torque can easily be obtained. In other words, since a large torque is naturally obtained as the electrically driven motor along with the two pump mechanisms, a very small-sized (miniaturized) electrically driven dual pump can be obtained as compared with a case where another independent electrically driven motor is connected to the drive shaft of the multi-coupling pump mechanisms.

In addition, since the single outer rotor is commonly used for the two pump mechanisms, the structure becomes simple and the outer rotor is stably rotated with respect to a hydraulic pressure variation within the respective pump chambers.

It is preferable that the first and second inner rotors are rotated with the common shaft supported on the housing as a center. In other words, the rotation center of each of the first and second inner rotors is prescribed by the common shaft. Thus, the structure becomes simple.

In addition, it is preferable that the partitioning wall is fixed onto the shaft. In this case, the partitioning wall is basically not rotated and the outer rotor is rotated with respect to the partitioning wall.

Furthermore, it is preferable that the partitioning wall is fixed onto the outer rotor. In this case, the partitioning wall is rotated together (integrally) with the outer rotor.

DETAILED DESCRIPTION OF THE INVENTION

Hereinafter, a detailed description of preferred embodiments according to the present invention will be made with reference to the accompanied drawings.

Figure 1:
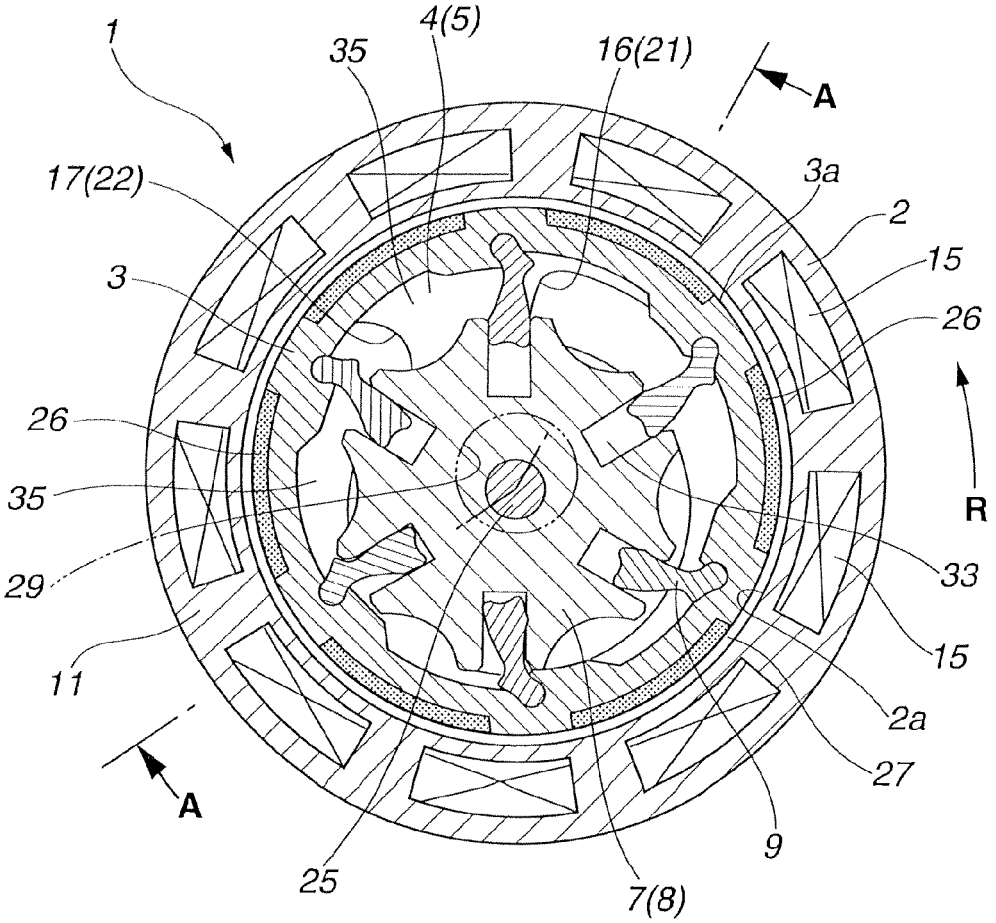
FIG. 1 is a laterally cross sectional view representing a first preferred embodiment of an electrically driven dual pump according to the present invention.
Figure 2:
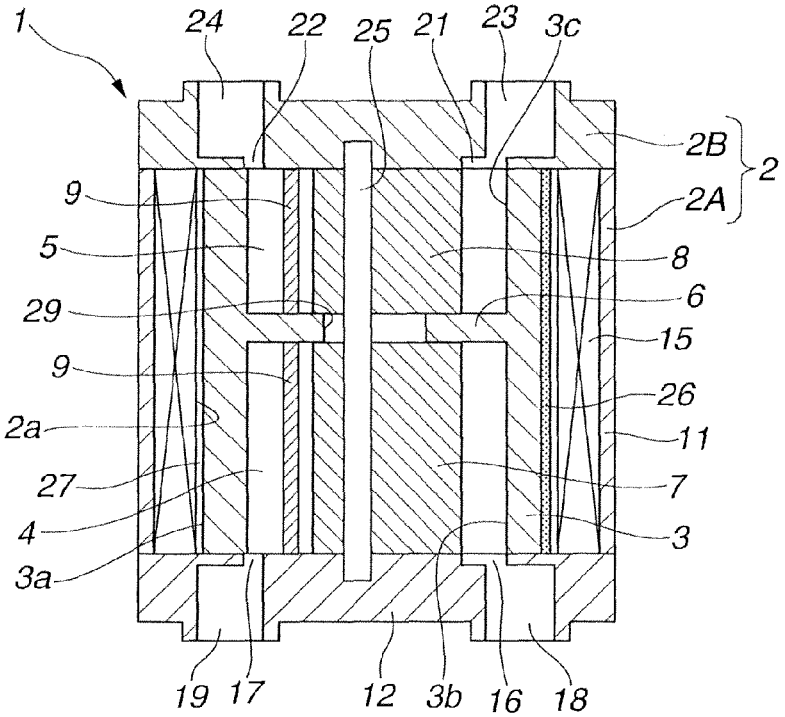
FIG. 2 is a longitudinally cross sectional view cut away along a line A-A in FIG. 1.

FIGS. 1 and 2 show laterally cross sectioned and longitudinally cross sectioned views of an electrically driven oil pump 1 from which working oil is supplied to two oil systems (two hydraulic pressure systems) of a hybrid vehicle as a first preferred embodiment of an electrically driven dual pump according to the present invention.

In FIGS. 1 and 2, this electrically driven oil pump 1 includes: a cylindrical housing 2 having an inner circumferential surface 2*a*; a cylindrical outer rotor 3 (loosely) fitted into the inner circumferential surface of this housing 2; a partitioning plate 6 to block a space at an inner peripheral side of outer rotor 3 into a first pump chamber 4 and a second pump chamber 5 in an axial direction of outer rotor 3; a first inner rotor 7 and a second inner rotor 8, each of first and second inner rotors being housed in a corresponding one of first pump chamber 4 and a second pump chamber 5; and a plurality of linkage plates 9 linking outer rotor 3 and each of first and second inner rotors 7, 8.

Above-described housing 2 is an essential element corresponding to a stator constituting a motor section with outer rotor 3. In this embodiment, housing 2 is divided into a body section 2A having a cylindrical circumferential wall 11 and a bottom wall 12 at one end of the circumferential wall 11; and an end plate 2B covering an opening of the other end of circumferential wall 11. Both of body section 2A and end plate 2B are integrally tightened by means of bolts or so forth (not shown). It should be noted that it is possible to form both ends of the body section which are open in a cylindrical shape and other separate end plates cover the openings at both ends of the body section.

A plurality of coils 15, for example, nine coils 15 are aligned at equal intervals to each other along a circumferential direction of housing 2 at an inside of circumferential wall 11.

These coils 15 are, for example, wound on laminated iron cores (not shown) and housing 2 is made of a synthetic resin at an inside of which these coils are molded together with the laminated iron cores. It should be noted that coils 15 are simply depicted in the drawings but these respective coils 15 shown in the drawings constitute magnetic poles of the stator.

It should also be noted that a first suction port 16 and a first discharge port 17 are positioned at mutually separate positions by an appropriate (first predetermined angle) angle so that first suction port 16 and first discharge port 17 are, as shown in FIG. 2, are communicated with a first suction opening 18 and a first discharge opening 19 at an outer surface of bottom wall 12 of housing 2, respectively. In the same way, at an inner side surface of end plate 2B, a second suction port 21 and a second discharge port 22 are installed at positions separated from each other by an appropriate angle (a second predetermined angle) to open toward second pump chamber 5 at the inside of housing 2. These second suction port 21 and second discharge port 22 are communicated with a second suction opening 23 and a second discharge opening 24 at the outside surface of end plate 2B, respectively as shown in FIG. 2. (It should be noted that, the first predetermined angle is approximately equal to the second predetermined angle, in this embodiment.)

It should be noted that, in FIG. 1, only first suction port 16 and first discharge port 17 are depicted but second suction port 21 and second discharge port 22 are basically formed to provide a symmetrical location to first suction port 16 and first discharge port 17, in other words, are placed at the same phase position.

In addition, a shaft 25 which provides a rotation center of first inner rotor 7 and second inner rotor 8 is interposed between bottom wall 12 and end plate 2B. This shaft 25 is extended in parallel to a center line of housing 2 and is placed at a position eccentric to the center of housing 2 by a predetermined quantity (distance). This shaft 25 has both (axial) ends supported by means of holes recessed on, for example, bottom wall 12 and end plate 2B.

Above-described outer rotor 3 is constituted by part of the pump section and, at the same time, serves as an essential element (a component) corresponding to the rotor of the motor section. A plurality of permanent magnets (for example, six) 26 in a plate-like form having an arc shape in cross section are attached onto outer circumferential surface 3*a* of outer rotor 3 at equal intervals. In the first embodiment, this outer rotor 3 is made of synthetic resin. Each permanent magnet 26 is buried into outer circumferential surface 3*a* of outer rotor 3 by molding each of permanent magnets using a mold previously arranged at a predetermined position. This cylindrical outer rotor 3 is fitted into housing 2 with a minute gap 27 (corresponds substantially to an air gap of a magnetic path) provided between outer circumferential surface 3*a* of outer rotor 3 and inner circumferential surface 2*a* of housing 2. Hence, outer rotor 3 is rotatable with respect to housing 2. It should be noted that, in this embodiment, an axle which limits a rotation center of outer rotor 3 is not equipped but outer rotor 3 is supported on the housing via an oil film formed within gap 27 so that outer rotor 3 is rotated concentrically with housing 2 without trouble. According to the necessity, for example, a guide mechanism such as an annular recessed groove installed at each of both end sections of housing 2 may be installed so that a centering of the outer rotor can be assured.

Above-described partitioning plate 6 is, in this embodiment, formed integrally with outer rotor 3, as shown in FIG. 2. This partitioning plate 6 is placed at an intermediate position in the axial direction of outer rotor 3. Especially, in the first embodiment shown in FIGS. 1 and 2, outer rotor 3 is placed at the position slightly deviated toward end plate 2B side so that an axial directional dimension of first pump chamber 4 is slightly larger than the axial directional dimension of second pump chamber 5. Partitioning plate 6 is simply circular plate and its center section has a circular opening section 29 through which above-described shaft 25 is penetrated. Above-described shaft 25 is eccentric to the rotation center of outer rotor 3 so that opening section 29 has a diameter with this eccentricity taken into consideration.

Permanent magnets 26 attached onto circumferential surface 3*a* of outer rotor 3 are extended over the substantial whole length of outer rotor 3 crossing the position of partitioning plate 6. In other words, individual permanent magnets 26 are disposed over both of first pump chamber 4 and second pump chamber 5.

Figure 3:
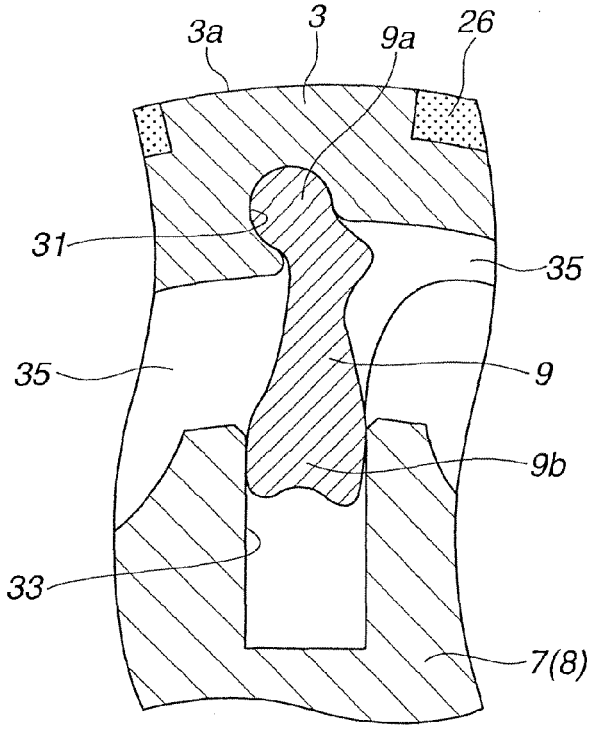
FIG. 3 is an expanded cross sectional view of a linkage plate.

Plate supporting grooves 31, each having a circular shape of cross section, are formed, as shown in the expanded view of FIG. 3, along the axial direction on the inner circumferential surface of outer rotor 3, namely, inner circumferential surface 3*b* of outer rotor 3 at first pump chamber 4 side and inner circumferential surface 3*c* at second pump chamber 5 side. These six plate supporting grooves 31 are placed at equal intervals of distances and, especially, disposed at positions not overlapped over permanent magnets 26 at the outer circumferential side as viewed from the circumferential direction of outer rotor 3. In details, each of permanent magnets 26 is located in an angular range which is defined between the adjacent two plate supporting grooves 31 disposed in the circumferential direction of outer rotor 3 with respect to a central axis of outer rotor 3. In other words, plate supporting grooves 31 are formed in a resin section 3*c* which are each located between adjacent two permanent magnets 26. It should be noted that, in this embodiment shown in FIGS. 1 and 2, six plate supporting grooves 31 on first pump chamber 4 and six plate supporting grooves 31 on second pump chamber 5 are mutually placed at mutually equal circumferential positions of outer rotor 3.

First inner rotor 7 and second inner rotor 8 are rotatably supported via shaft 25 placed at the eccentric position to the centers of housing 2 and outer rotor 3. Six slots 33 are at equal intervals and radially formed on the respective outer peripheral surfaces. It should be noted that, in this embodiment, these inner rotors 7, 8 can be structured by means of die casts of the synthetic resin or of light alloy in the same way as outer rotor 3. It should be noted that opening section 29 of partitioning plate 6 is not overlapped on above-described slots 33. Hence, the side surfaces of respective inner rotors 7, 8 substantially close opening section 29.

As described above, each of first and second inner rotors 7, 8 is eccentrically placed with respect to the inner circumferential surface of outer rotor 3 in each pump chamber 4, 5. Therefore, a space of a crescent shape is provided between both pump chambers 4, 5 due to the eccentric position of each inner rotor 7, 8 to the inner circumferential side of outer rotor 3. Then, for the space in the crescent shape of first pump chamber 4, first suction port 16 and first discharge port 17, are opened and, for the space in the crescent shape of second pump chamber 5, second suction port 21 and second discharge port 22 are opened. These spaces of crescent shapes within pump chambers 4, 5 are partitioned into six chambers 35 by means of six linkage plates 9. Each of above-described linkage plates 9 is, as shown in FIG. 3, a plate shape having a cross section in a substantially triangular shape, as shown in FIG. 3. A head section 9*a* having a circular shape in cross section at the outer circumferential end is swingably fitted into plate supporting grooves 31 of outer rotor 3. In addition, an expansion section 9*b* which is expanded in the circumferential direction at the inner peripheral end is slideably inserted within respective slots of inner rotors 7, 8.

As is easily appreciated from FIG. 1, in accordance with a change in rotational positions of outer rotor 3 and first and second inner rotors 7, 8 which are mutually made eccentric to each other, a distance between inner circumferential surfaces 3*b*, 3*c* of outer rotor 3 and outer circumferential surfaces of inner rotors 7, 8 are varied so that an angular positional relationship between respective plate supporting grooves 31 and slots 33 is also varied. Hence, accordingly, expansion section 9*b* of linkage plate 9 is swung and advanced and retarded within corresponding slots 33. Linkage plate 9 is basically acted to push inner rotors 7, 8 in the same direction when outer rotor 3 is revolved in a counterclockwise direction (arrowed R direction) of FIG. 1.

The volume of each chamber 35 blocked by means of linkage plate 9 becomes minimum at a right lower side of FIG. 1, becomes gradually increased along with the rotation in an arrow-marked R direction from the minimum position, and again decreased after the maximum position at the upper part of FIG. 1. After the maximum position at the upper part of FIG. 1, the volume is again decreased. Hence, in the same way as the well known vane pump and so forth, a pumping action which supplies oil under pressure from suction ports 16, 21 at the right side of FIG. 1 to discharge ports 17, 22 at the left side of FIG. 1 can be obtained.

That is to say, outer rotor 3, first inner rotor 7, and six linkage plates 9 constitute a first pump section which supplies oil under pressure from first suction port 16 to first discharge port 17 and outer rotor 3, second inner rotor 8, and six linkage plates 9 constitute a second pump section which supplies oil under pressure from second suction port 21 to second discharge port 22.

Then, as described above, housing 2 corresponding to the stator and outer rotor 3 corresponding to the rotor constitute the motor section which simultaneously drives both pump sections. In this embodiment, nine coils of U1 through U3, V1 through V3, and W1 through W3 are disposed within housing 2 side and six permanent magnets 26 which provide N poles and S poles alternatively on outer rotor 3 side. As a whole, the dual pump in this embodiment constitutes a three-phase six-pole nine-slot brushless motor. As a connection of coils 11, either a delta connection or star connection may be selected. A drive circuit not shown drives outer rotor 3 as described above in the counterclockwise direction. It should be noted that, for the number of permanent magnets and coils 15, various changes such as an eight-pole and a twelve-slot can be made.

Figure 4:
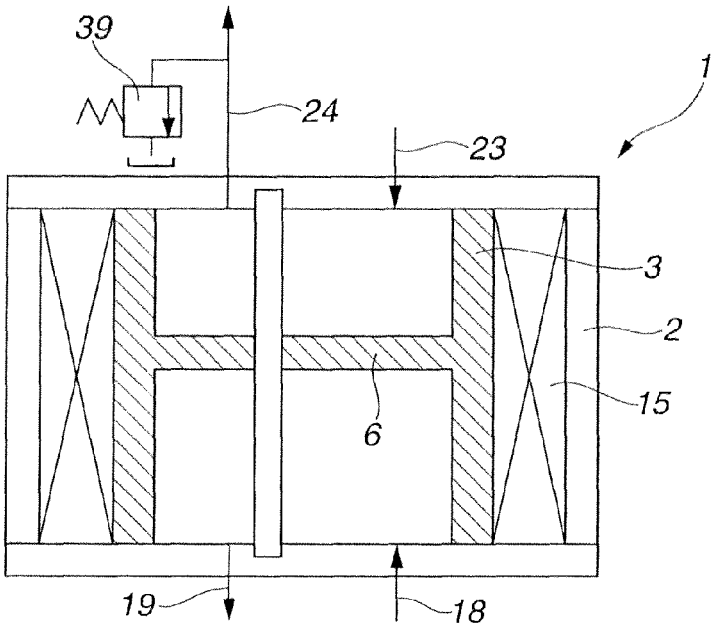
FIG. 4 is an explanatory view of a use example of the electrically driven dual pump.

It is possible for the above-described first pump section and second pump section to be utilized for the supply of oil of mutually different hydraulic pressure systems in which the requested hydraulic pressure and oil quantity are different from each other. For example, as shown in FIG. 4, the first pump section is used to perform the lubrication of the hydraulic pressure system in which a relatively high oil quantity is requested (required), for example, each part of the internal combustion engine, the transmission, and so forth and the second pump section supplies oil to the transmission via a pressure regulator 39 as a transmission purpose hydraulic pressure of the other hydraulic pressure systems in which a relatively high hydraulic pressure is requested (required).

In the first embodiment described above, as compared with the previously proposed electrically driven duel pump described in the BACKGROUND OF THE INVENTION in which the multi-coupling pump mechanisms and the electrically driven motor are serially linked in the axial direction of the housing, an axial dimension of the electrically driven dual pump can be small-sized to a considerable degree but outer rotor 3 serves to constitute the two pump sections and serves to constitute the motor section. Especially, housing 2 and outer rotor 3 constituting the motor section basically require the axial directional size corresponding to each pump section. A torque required to drivingly rotate the dual pump as the dual pump is increased. On the other hand, as a result of elongating the axial directional size of housing 2 and outer rotor 3 required to form two pump chambers 4, 5, elongations of coils 15 and permanent magnets 26 can easily be assured. Hence, the motor section having a large torque can necessarily be obtained. Hence, a large small-sized electrically driven dual pump can be achieved as the whole dimension including the electrically driven motor.

In addition, mutually different reaction forces are acted upon outer rotor 3 from respective inner rotors 7, 8 due to a difference in the hydraulic pressure between the first pump section and the second pump section. However, outer rotor 3 which has a sufficient rigidity is commonly used for the two pump sections so that a stable rotation of the two pump sections can be obtained.

It should be noted that, in the first preferred embodiment, the first pump section and the second pump section have substantially the same structures except the axial directional size thereof. However, the present invention is not limited to this. For example, a diameter of inner circumferential surface 3*b* of outer rotor 3 in first pump chamber 4 and the diameter of inner circumferential surface 3*c* of outer rotor 3 in second pump chamber 5 can mutually be differentiated (made different). Alternatively, the diameters of the outer circumferential surfaces of first inner rotor 7 and second inner rotor 8 can be made different from each other. It should be noted that it is possible to modify the discharge capacities of the respective pump sections depending upon a setting of the eccentricity of shaft 25 to the center of outer rotor 3. It should also be noted that the numbers of linkage plates 9 and slots 33 in the respective pump sections can be made different (differentiated) so that the discharge capacities can be tuned to various characteristics. In this case, if, with the number of plate supporting grooves 31 of outer rotor 3 excessively (many) processed than the required, linkage plates 9 are attached onto part of excessively processed plate supporting grooves 31, it is possible to commonly use outer rotor 3 for the discharge capacities having the various characteristics.

In addition, in the first embodiment, each of first and inner rotors 7, 8 is rotatable to shaft 25. However, with each of first and second inner rotor 7, 8 fixed onto shaft 25, it is possible to support rotatably shaft 25 on housing 2.

Furthermore, in the first embodiment, the eccentricity of the position of the rotation center of each of first and second inner rotors 7, 8, namely, the eccentricity of shaft 25 to the center of outer rotor 3 is fixedly determined. However, it is possible to variably control a discharge capacity of each of the first and second pump sections if a variable mechanism is disposed at the supporting section of shaft 25 so that the eccentricity of the shaft to the center of outer rotor 3 is modified. It should be noted that, although the structure is complex, shaft 25 is independently installed for each of the pump sections and the eccentricities of the individual shafts can be modified. The discharge capacity for each of the pump sections can be adjusted.

Figure 5:
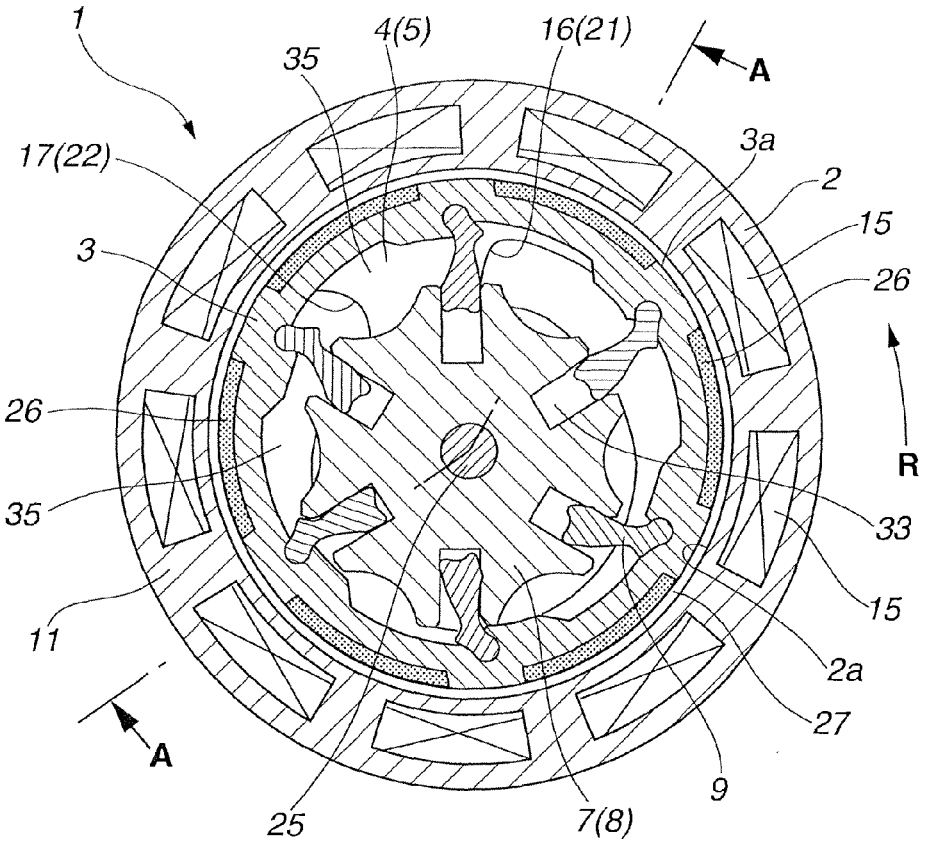
FIG. 5 is a lateral cross sectional view representing a second embodiment of the electrically driven dual pump in which a partitioning plate is modified.
Figure 6:
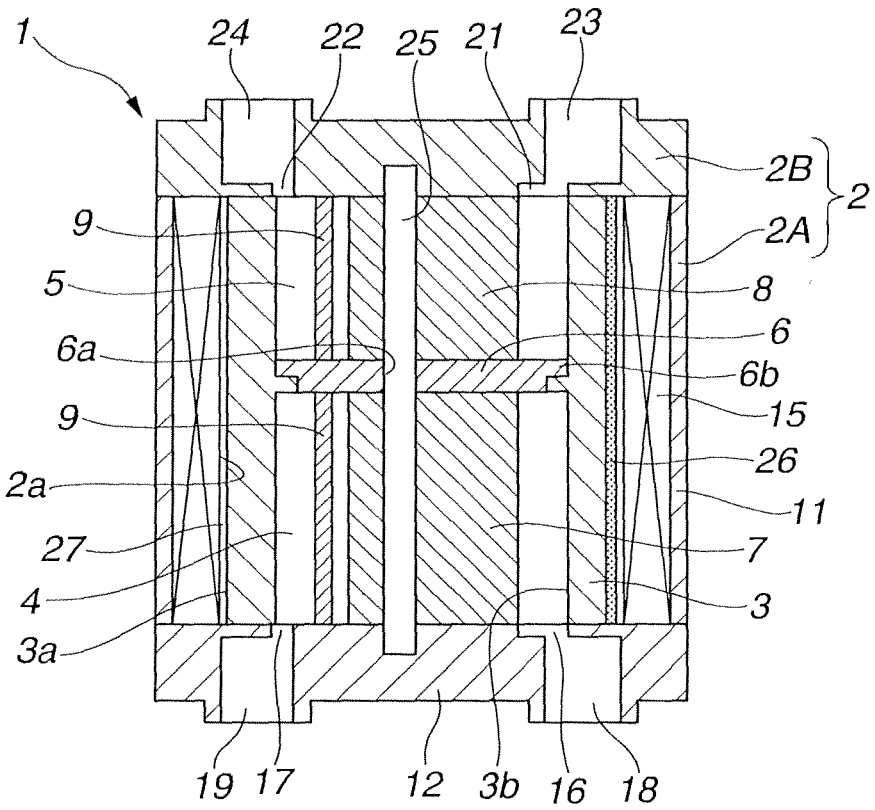
FIG. 6 is a longitudinal cross sectional view cut away along a line of A-A in FIG. 5.

Next, FIGS. 5 and 6 show a second preferred embodiment of the electrically driven dual pump in which the structure of partitioning plate 6 is modified. In this embodiment, partitioning plate 6 is fixed onto shaft 25. That is to say, an attaching hole 6*a* of circular partitioning plate 6 is provided at the position eccentric to the center of partitioning plate 6 and partitioning plate 6 is attached to shaft 25 penetrated through attaching hole 6*a*. Then, an outer circumferential edge 6*b* of partitioning plate 6 is relative rotatably contacted on the inner circumferential surface of outer rotor 3. In this embodiment, a projection disposed on the inner circumferential surface of outer rotor 3 and a cut-out section of outer circumferential edge 6*b* of partitioning plate 6 are engaged with each other in a stepwise manner.

In the second embodiment, in the same way as the first embodiment described before, the substantially independent first pump section and second pump section are formed. Oil can be supplied, for example, to one of the hydraulic pressure systems in which a high oil flow quantity is requested (required) and the other hydraulic pressure system in which the high hydraulic pressure is requested (required).

It should be noted that above-described shaft 25 is constituted by mutually different members between the first pump section and the second pump section and shaft 25 thus structured may be linked together in a single shaft at part of partitioning plate 6.

According to the present invention, the torque can largely be obtained as the electrically driven motor along with an expansion (enlargement) of a dimension of the outer rotor and the housing required as the dual pump. Thus, the small-sized dual pump can be provided as compared with the case where the other independent electrically driven motor is connected to the drive shaft of the multi-coupling pump mechanisms and the structure of the small-sized dual pump can be simplified.

This application is based on a prior Japanese Patent Application No. 2012-179739 filed in Japan on Aug. 14, 2012. The entire contents of this Japanese Patent Application No. 2012-179739 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. An electrically driven dual pump, comprising:

a housing comprising suction ports and discharge ports at respective end sections of the housing, the housing having a cylindrical inner circumferential surface and comprising a plurality of coils disposed in a circumferential direction of the housing;

a common shaft that extends between the respective end sections;

a cylindrical outer rotor rotatably disposed with respect to the inner circumferential surface side of the housing and having a plurality of permanent magnets on an outer circumferential surface of the outer rotor to comprise a motor section in cooperation with the coils of the housing;

a partitioning plate disposed to partition an inner circumferential side of the outer rotor into a first pump chamber and a second pump chamber;

a first inner rotor and second inner rotor, each of the first and second inner rotors being rotatably disposed within the first and second pump chambers with a rotation center of each of the first and second inner rotors eccentric to the center of the outer rotor, comprising a space against the outer rotor which is in communication with a corresponding one of the suction ports and the corresponding one of the discharge ports, and a plurality of slots radially formed on an outer circumferential surface of each of the first and second inner rotors; and a plurality of linkage plates disposed to transmit a rotational force from the outer rotor to each of the first and second inner rotors, the respective linkage plates having an outer radial end section swingably supported on an inner circumferential section of the outer rotor and an inner radial end section slideably received in the respective slots of the first and second inner rotors, the linkage plates dividing the space formed between the outer rotor and each of the first and second inner rotors into a plurality of chambers, wherein the partitioning plate protrudes from the outer rotor.

2. The electrically driven dual pump as claimed in claim 1, wherein the first and second inner rotors are rotated with the common shaft supported on the housing as a center.

3. The electrically driven dual pump as claimed in claim 2, wherein the partitioning plate is fixed onto the outer rotor.

4. The electrically driven dual pump as claimed in claim 1, wherein a diameter of the inner circumferential surface of the outer rotor in the first pump chamber is equal to a diameter of the inner circumferential surface of the outer rotor in the second pump chamber.

5. The electrically driven dual pump as claimed in claim 1, wherein diameters of the outer circumferential surfaces of the first and second inner rotors are equal to each other.

6. The electrically driven dual pump as claimed in claim 1, wherein the outer rotor comprises plate supporting grooves formed on an inner circumferential surface of the outer rotor and an outer radial end section is swingably fitted into the respective plate supporting grooves, and wherein the respective permanent magnets are disposed on the outer circumferential surface of the outer rotor in an angular range defined between respective adjacent two of the plate supporting grooves which are disposed adjacent to each other in the circumferential direction of the outer rotor.

7. The electrically driven dual pump as claimed in claim 1, wherein the suction ports comprise a first suction port and a second suction port, and the discharge ports comprise a first discharge port and a second discharge port, wherein the housing comprises a cylindrical circumferential wall; and a body section having a cylindrical bottom wall at one end of the cylindrical circumferential wall and an end plate covering the other end of the circumferential wall, and wherein the first suction port is formed in a first end section of the bottom wall of the housing configured to be in communication with the first pump chamber, and the first discharge port is formed in a second end section of the bottom wall of the housing configured to be in communication with the first pump chamber, the first and second end sections being separated from each other by a first predetermined angle, and wherein the second suction port is formed on a third end section of the end plate of the housing configured to be in communication with the second pump chamber, and the second discharge port is formed in a fourth end section of the end plate of the housing configured to be in communication with the second pump chamber, the third and fourth end sections of the housing being separated from each other by a second predetermined angle and being opposite to the first and second end sections.

8. The electrically driven dual pump as claimed in claim 7, wherein an outer circumferential surface of the bottom wall is provided with a first suction opening in communication with the first suction port and with a first discharge opening in communication with the first discharge port, and wherein the outer circumferential surface of the end plate of the housing is provided with a second suction opening in communication with the second suction port and a second discharge opening in communication with the second discharge port.

9. The electrically driven dual pump as claimed in claim 8, wherein the outer rotor, the first inner rotor and the linkage plates comprise a first pump section which supplies oil under pressure from the first suction port to the first discharge port, and the outer rotor, the second inner rotor and the linkage plates comprise a second pump section which supplies oil under pressure from the second suction port to the second discharge port.

10. The electrically driven dual pump as claimed in claim 1, wherein the plurality of chambers into which the linkage plates divide the space include the first pump chamber and the second pump chamber.

* * * * *